US007017577B2

(12) United States Patent
Matich

(10) Patent No.: US 7,017,577 B2
(45) Date of Patent: Mar. 28, 2006

(54) FACE MASK WITH SEAL AND NEUTRALIZER

(76) Inventor: Ronald D. Matich, P.O. Box 2541, Baxter, MN (US) 56401

( * ) Notice: Subject to any disclaimer, the term of this patent is extended or adjusted under 35 U.S.C. 154(b) by 353 days.

(21) Appl. No.: 10/052,532

(22) Filed: Jan. 18, 2002

(65) Prior Publication Data

US 2003/0136410 A1 Jul. 24, 2003

(51) Int. Cl.
*A62B 18/08* (2006.01)

(52) U.S. Cl. ..... 128/206.14; 128/206.19; 128/206.25

(58) Field of Classification Search ..... 128/206.25, 128/206.14, 205.27, 205.28, 205.29, 206.12, 128/206.15, 206.21, 206.23, 206.24, 201.17, 128/206.17, 201.25
See application file for complete search history.

(56) References Cited

U.S. PATENT DOCUMENTS

| | | | | |
|---|---|---|---|---|
| 2,552,520 | A | 5/1951 | Coler | |
| 2,703,576 | A | 3/1955 | Furr, Jr. | |
| 2,809,633 | A | 10/1957 | Swearingen et al. | |
| 2,921,581 | A | 1/1960 | Swearingen et al. | |
| 2,928,388 | A | 3/1960 | Jaroslaw | |
| 3,049,121 | A | 8/1962 | Brumfield et al. | |
| 3,357,426 | A * | 12/1967 | Cohen | 128/202.27 |
| 3,565,059 | A | 2/1971 | Hauser et al. | |
| 3,695,265 | A | 10/1972 | Brevik | |
| 4,004,584 | A | 1/1977 | Geaney | |
| 4,240,420 | A | 12/1980 | Riaboy | |
| 4,354,489 | A | 10/1982 | Riaboy | |
| 4,367,732 | A | 1/1983 | Poulsen et al. | |
| 4,467,799 | A * | 8/1984 | Steinberg | 128/206.14 |
| 4,503,851 | A * | 3/1985 | Braunroth | 128/203.29 |
| 4,600,002 | A * | 7/1986 | Maryyanek et al. | 128/206.19 |
| 4,932,078 | A | 6/1990 | Jones et al. | |
| 4,945,907 | A | 8/1990 | Tayebi | |
| 4,959,047 | A | 9/1990 | Tripp, Jr. | |
| 4,966,140 | A * | 10/1990 | Herzberg | 128/206.19 |
| 4,984,302 | A | 1/1991 | Lincoln | |
| 4,997,861 | A | 3/1991 | Hechenberger et al. | |
| 5,094,236 | A | 3/1992 | Tayebi | |
| 5,143,752 | A | 9/1992 | Nakajima et al. | |
| 5,392,773 | A | 2/1995 | Bertrand | |
| 5,400,780 | A | 3/1995 | Nishino | |
| 5,492,882 | A * | 2/1996 | Doughty et al. | 502/417 |

(Continued)

OTHER PUBLICATIONS

WO 99/65347, Hollander et al, "Fire Escape Mask," Dec. 23, 1999.*

*Primary Examiner*—Mital Patel

(57) ABSTRACT

A sealed face mask. The face mask may be a common paper face mask or a more technically complex gas mask. The face mask includes a periphery. The periphery includes a seal that surrounds the nostrils and the mouth and that sticks to the skin of the face. The adhesive of the seal may be a skin friendly adhesive or a skin unfriendly adhesive. With the skin unfriendly adhesive, the adhesive includes a strength sufficient to remove a first layer of skin from the face when the seal is pulled from the face. The seal includes a strip that may be elastomeric. The periphery of the face mask may be elastomeric. The face mask includes a neutralizing agent to minimize harmful effects of substances passing through the face mask. Further disclosed is a method for fixing the face mask to the face. Also disclosed are sealing strips for the lower ends of the legs of a pair of pants, sealing strips of the outer ends of the sleeves of a shirt, and sealing strips for other articles of clothing.

2 Claims, 13 Drawing Sheets

U.S. PATENT DOCUMENTS 5,529,056 A * 6/1996 Brunson et al. ..... 128/200.24
5,561,863 A 10/1996 Carlson, II
5,698,187 A 12/1997 Naggiar
5,735,270 A 4/1998 Bayer
5,803,075 A * 9/1998 Yavitz ..... 128/206.25
5,803,639 A 9/1998 Gusakov et al.
5,842,470 A 12/1998 Ruben
5,918,598 A * 7/1999 Belfer et al. ..... 128/206.25
6,029,667 A 2/2000 Lurie
6,055,982 A * 5/2000 Brunson et al. ..... 128/206.12
6,070,578 A 6/2000 Baughman et al.
6,082,360 A 7/2000 Rudolph et al.
6,098,624 A 8/2000 Utamaru
6,116,236 A 9/2000 Wyss
6,152,137 A 11/2000 Schwartz et al.
6,179,804 B1 1/2001 Satterfield
6,196,223 B1 * 3/2001 Belfer et al. ..... 128/206.25
6,262,330 B1 7/2001 Fujisawa et al.
6,286,144 B1 9/2001 Henderson et al.
6,297,421 B1 10/2001 Kitazaki et al.
6,308,330 B1 10/2001 Hollander et al.
6,310,166 B1 10/2001 Hickey et al.
6,323,275 B1 11/2001 Takahashi et al.
6,341,606 B1 * 1/2002 Bordewick et al. .... 128/206.25
6,453,902 B1 * 9/2002 Hollander et al. ..... 128/201.17
6,460,539 B1 10/2002 Japuntich et al.
6,484,722 B1 11/2002 Bostock et al.
6,520,181 B1 2/2003 Baumann et al.
6,543,450 B1 * 4/2003 Flynn ..... 128/206.19
6,609,516 B1 * 8/2003 Hollander et al. ..... 128/201.17
6,740,067 B1 * 5/2004 Leise et al. ..... 604/332
6,748,609 B1 6/2004 Garigan
2001/0008027 A1 7/2001 Duplock

* cited by examiner

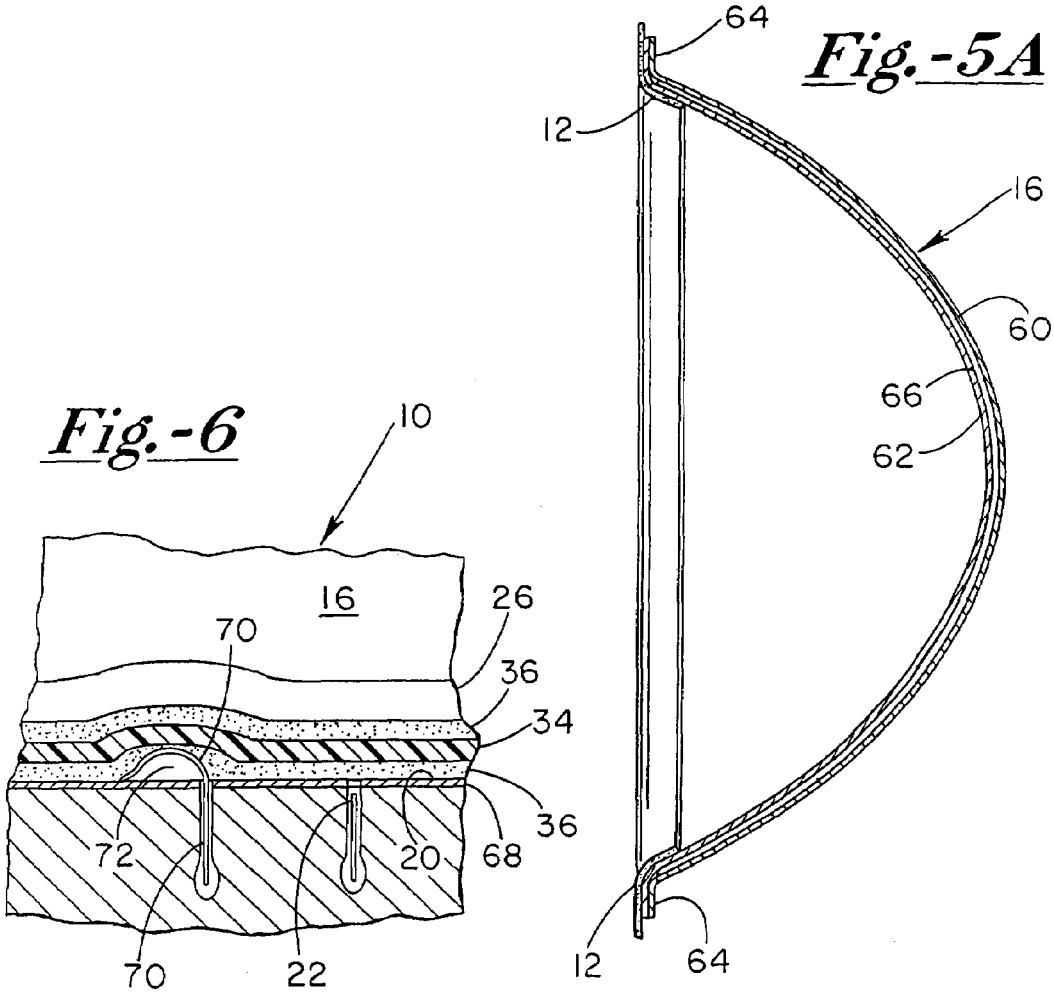
Fig.-5A
64
12
16
60
66
62
12
64
Fig.-6
10
16
26
70
36
34
36
72
20
68
70
22
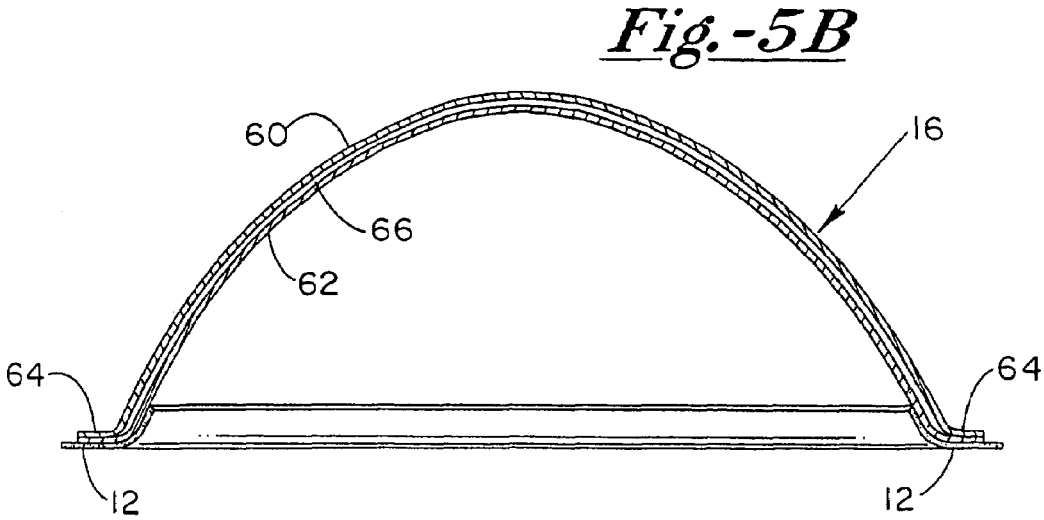
Fig.-5B
60
16
66
62
64
64
12
12

118
120
116
110
108
106
112
114
104
102

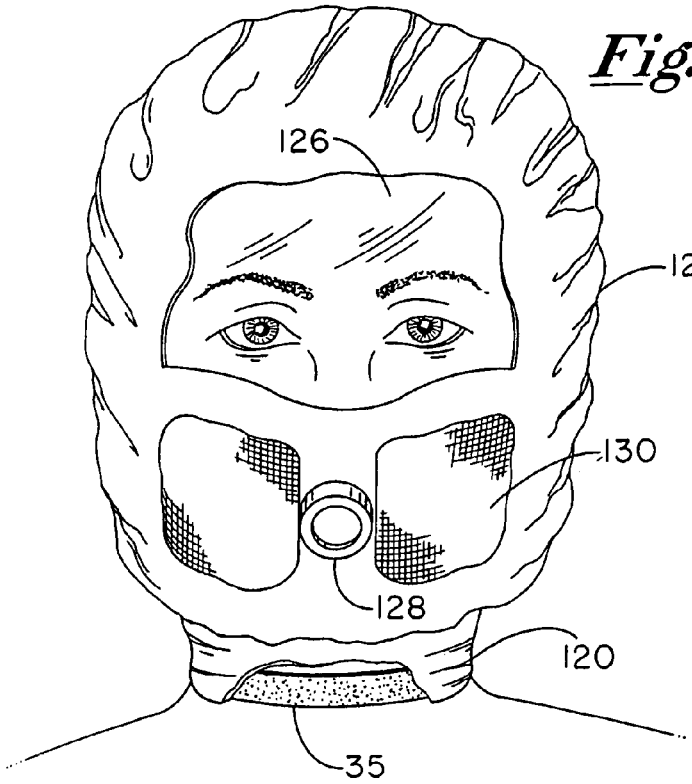
Fig.-13A
Fig.-13B
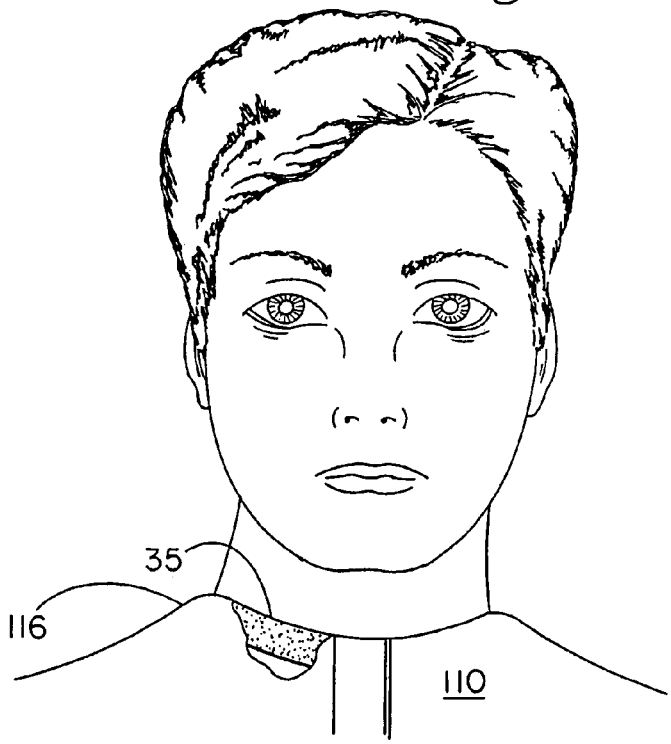

FACE MASK WITH SEAL AND NEUTRALIZER

The present invention relates generally to a face mask, more particularly to a face mask having a seal, and specifically to a sealed face mask having multiple features to maximize chances of survival.

BACKGROUND OF THE INVENTION

The auto body repairman knows best. He or she best knows that the man on the street has little or no chance of surviving bioterrorism. He or she best knows the commuter has little chance against a sarin attack in a subway. He or she best knows that the college football game spectator maximizes his or her chances at survival by madly rushing to an exit—instead of politely waiting for the deadly rain—when the stadium is attacked with crop dusters.

How does the auto body repairman know best? Because when finished painting a car, he or she looks in the mirror and examines and picks at the ring of paint that encircles his or her nostrils and mouth. This ring of paint means that the face mask—whether a common paper face mask or technically complex gas mask—is ineffective. This ring of paint means that paint particles and paint vapor have been merely slowed down—with some paint particles drying and forming the ring as they are slowed down—and have not been stopped, but instead have passed between the periphery of the face mask and the skin of the face and have entered his or her nostrils, mouth, throat and lungs.

SUMMARY OF THE INVENTION

A feature of the present invention is a sealed face mask.

Another feature of the present invention is the provision in a face mask having an adhesive seal, of the seal being placed in a position on the face where there is minimum movement when the wearer of the face mask talks or, more precisely, yells. The lower jaw especially moves when one yells, but the lower jaw "slips" within the skin of the face such that the skin of the face moves significantly less than the lower jaw. Of course, the skin of the underside of the lower jaw is greatly displaced, but not the skin of the face or the skin of the front of the face. Such a position on the face where there is such minimal movement of the skin is critical to the present passive face mask and such a position extends from a first position on the bridge of the nose above the nostrils to the right side of the nose, from said right side of the nose to a position on the front of the face beyond the right side of the mouth, from said position beyond the right side of the mouth to a position on the front of the face below the lower lip and on the front of the chin, from said position below the lower lip to a position on the front of the face beyond the left side of the mouth, from said position beyond the left side of the mouth to the left side of the nose, from said left side of the nose back to said first position on the bridge of the nose such that the nostrils and mouth are completely surrounded and such that the face mask is sealed where there is minimal movement of the skin of the face when the wearer yells.

Another feature of the present invention is the provision in a face mask having an adhesive seal, of the seal on the face mask being skin unfriendly such that, upon a pulling of the seal from the face, a first layer of skin is peeled off the face.

Another feature of the present invention is the provision in a face mask having an adhesive seal, of the seal on the face mask having a first face with a first adhesive for engaging the periphery of the face mask and a second face with a second adhesive for engaging the skin of the face, with the relative strengths of the first and second adhesives being different.

Another feature of the present invention is the provision in a face mask having an adhesive seal, of the strength of the second adhesive being relative greater than the strength of the first adhesive such that the seal remains on the skin upon a pulling of the face mask from the face.

Another feature of the present invention is the provision in a face mask having an adhesive seal, of the strength of the first adhesive being relatively greater than the strength of the second adhesive such that the face mask and seal are pulled from the face together.

Another feature of the present invention is the provision in a face mask having an adhesive seal, of the adhesive on the seal being skin friendly.

Another feature of the present invention is the provision in a face mask having an adhesive seal, of the seal having a strip with a first face having a first adhesive and a second face having a second adhesive, and of the strip being elastomeric to accommodate movement of the face such as a movement created by talking.

Another feature of the present invention is the provision in a face mask having an adhesive seal, of the periphery of the covering of the face mask being elastomeric to accommodate movement of the strip.

Another feature of the present invention is the provision in a face mask having an adhesive seal, of the second adhesive being rubber-based and being applied to the skin of the face to further accommodate movement of the face.

Another feature of the present invention is the provision in a face mask having an adhesive seal, of the first adhesive being rubber-based and being applied between the seal and the periphery to accommodate movement of the strip.

Another feature of the present invention is the provision in a face mask having an adhesive seal, of a neutralizing agent engaged to the face mask where the face mask is structured to permit air into the face mask to neutralize substances that pass through the face mask.

Another feature of the present invention is the provision in a face mask having an adhesive seal, of the face mask having activated charcoal where the face mask is structured to permit air into and out of the face mask, and of the activated charcoal rendering less harmful substances passing into the face mask.

Another feature of the present invention is the provision in a face mask having an adhesive seal, of the face mask being secured to the face solely by said adhesive seal.

Another feature of the present invention is the provision in a face mask having an adhesive seal, of the face mask comprising paper.

Another feature of the present invention is the provision in a method for fixing and removing a face mask to and from a face, of the steps of cleaning a continuous band of skin that completely surrounds the nostrils and mouth, removing hair from the continuous band of skin, and fixing the seal of the face mask onto the band of skin that has been cleaned and from which hair has been removed.

Another feature of the present invention is the provision in the step of removing hair from the continuous band of skin, of the step of removing hair from below an outermost level of the skin to maximize the amount of time remaining until said hair grows back to degrade said seal.

Another feature of the present invention is the provision in the method for fixing and removing a face mask to and from a face, of the step of selecting a skin unfriendly adhesive for the seal of the face mask such that, upon pulling the seal from the skin of the face, a first layer of skin is removed from the face.

Another feature of the present invention is an apparatus for sealing a portion of the body, wherein the apparatus includes a set of strips of tape having first and second adhesive faces and release strips over the adhesive faces. The first adhesive face is adaptable to stick to an article selected from the group of cloth articles, fabric articles and plastic articles such as face masks, footwear such as socks or shoes, hand wear such as gloves or mittens, pants or other leg wear, upper body wear for the torso such as jackets or shirts, and hoods. The second adhesive face is skin unfriendly such that when peeled by hand off the skin the horny layer of skin is peeled off the epidermis whereby the tape seals the article to the skin. The articles of clothing have openings that are sealed to the skin with the tape. For example, tape of the present invention is placed inside the opening at the bottom of each of the pants' legs and then is stuck to the skin of the respective ankles. Tape may also be placed at the waist opening of the same pair of pants, and this tape is then stuck to the skin of the waist. The pair of pants is thus sealed against entry of foreign agents such as toxins.

An advantage of the present invention is that a positive and relatively permanent seal is formed. A feature that contributes to this advantage is the aggressive skin unfriendly seal. Violent movement of the mouth such as yelling orders, yelling for an ambulance, yelling for your children and spouse is less likely to disengage an aggressive seal from the yeller's face. A jarring of the mask, such as a bumping into another person's head or back in a smoke filled staircase, is less likely to disengage an aggressive seal.

Another advantage of the present invention is that a seal is obtained quickly. A feature that contributes to this advantage is the aggressive skin unfriendly seal. The time that it takes to read this sentence is the time that a subway rider may have to put on a mask. Cleaning one's face is out of the question. A seal with an aggressive adhesive cuts through oil and dirt. A seal with an aggressive adhesive cuts through blackened skin colored by an explosion.

Another advantage of the present invention is that the periphery about the face mask is no longer the path of least resistance to air; air must now pass through the face mask where the face mask is structured to permit the air to pass. Accordingly, since the route of passage of air is now controlled, a neutralizer may be placed at the controlled entrance. Hence, the chances are maximized that 100% of the air that is breathed is neutralized.

Another advantage of the present invention is that the face mask is inexpensive. A feature that contributes to this advantage is that the face mask may be formed of paper or of a plastic. Since the face mask is inexpensive, the face mask may be made available to a greater number of people. Since the face mask is inexpensive, one person may carry or store multiple masks for use by himself or herself or for use by other people.

Another advantage of the present invention is that the face mask is simple to manufacture, simple to put on, and simple to take off. The face mask may be pressed into shape when manufactured. The face mask includes peel off backing to expose the adhesive. Even if a skin unfriendly adhesive is used, the seal may be dissolved from the face by products found in a woman's makeup case.

Another advantage of the present invention is that the face mask may be put on with one hand. A conventional face mask having a pair of rubber band loops requires a two hand operation: one hand to hold the mask to the face and the other hand to loop the rubber bands around to the back of the head. With the present face mask having the adhesive seal, only one hand is required to lift the face mask up to the face, whereupon the thumb and forefinger are used to press on the periphery of the face mask to set the seal to the skin of the face.

Another advantage relates to the method of fixing and removing the face mask to and from the face. When one has time to prepare one's face for the mask, the step of removing hair from the skin of the face provides a more positive seal for both men and women. Further, removing the hair to a level below the outermost level of the skin provides both an even more positive seal and a seal that lasts for a longer period of time. With some men, the afternoon shadow appears by lunchtime.

BRIEF DESCRIPTION OF THE DRAWINGS

FIG. 5A shows a top to bottom cross-section of the face mask of FIG. 1.

FIG. 5B shows a side to side cross section of the face mask of FIG. 1.

FIG. 6 shows a cross-section of a face mask on skin.

FIG. 13A shows a hood sealed to the skin of the neck.

FIG. 13B shows the neck opening of upper body wear sealed to the skin of the neck.

DESCRIPTION

Figure 1A:
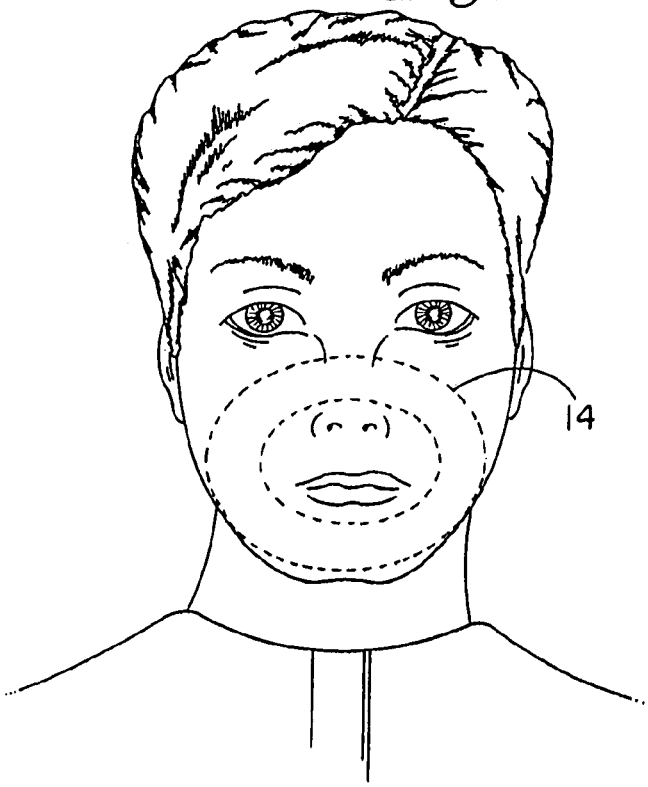
FIG. 1A shows a face having a band of skin that has been cleaned and from which hair has been removed.
Figure 1B:
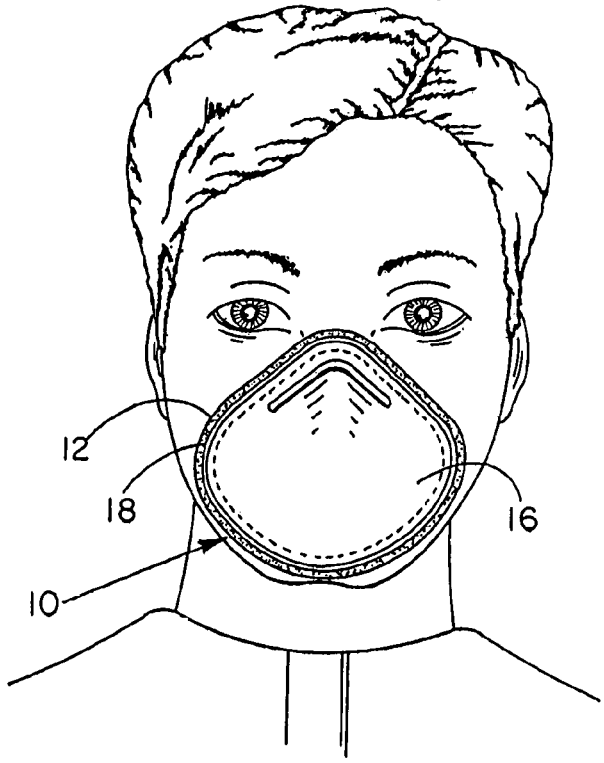
FIG. 1B shows a preferred embodiment of the present sealed face mask where the seal of the face mask has been pressed upon the cleaned and hair free band of skin shown in FIG. 1A.

As shown in FIGS. 1 and 2, the present face mask 10 includes a seal 12 for engaging a band of skin 14 that has been cleaned and from which hair has been removed. The face mask 10 further includes a covering 16 having a periphery 18. The seal 12 is engaged between the periphery 18 and the band of skin 14 to form a positive seal between the face mask 10 and the face, to minimize leakage of intake air flowing between the periphery 18 and the face, and to force air through the covering 16. With the path of least resistance now the route through the covering 16, air must flow through activated charcoal engaged in the covering 16.

More particularly, as shown in FIG. 1, the band of skin 14 runs from a bridge of the nose, down the right side of the nose, to a position on the front of the face beyond the right side of the mouth, to a position on the front of the face below the lower lip on the front of the chin, to a position on the front of the face beyond the left side of the mouth, up the left side of the nose and back to the bridge of the nose. The band of skin 14 is continuous. It is critical to the present passive face mask that the mask 10 cover both the nose and mouth. It is critical to the present passive face mask that the periphery 18 be on the front of the face where the skin of the face moves relatively little when one yells, as compared to the skin of the underside of the lower jaw which moves a relatively great amount as the lower jaw is the jaw that is extended and moving when one yells.

Prior to placement of the face mask 10 on the face, it is preferred that the face be cleaned. Of course, it is more practical, easier and quicker to clean a greater area of the face than merely the band of skin 14. However, the area that is cleaned preferably includes the band of skin 14. Water may be used to clean the face. More preferred is soap and water so as to remove oil from the face.

Further, it is preferred that the band of skin 14 have no hair above a surface 20 of the face. Shaving, such as with a razor or electric razor, leaves hairs 22 having a top end at or about at the surface 20 of the face, as shown in FIG. 6. It is more preferred that the band of skin 14 have the top ends of the hairs 22 below the face surface 20. Hair removal products leave hairs 22 having a top end below the surface 20 of the face or the hair totally removed from the root. Such hair removal products include liquid or cream depilatory compositions. Such hair removal products that remove hair from below a surface of the skin include the Naggiar U.S. Pat. No. 5,698,187 issued Dec. 16, 1997 and entitled Cold Wax Depilatory Composition, which is hereby incorporated by reference in its entirety. Depilatory methods or compositions that can be used to remove hair quickly, such as in a matter of a minute, are preferred. Further, mechanical and/or electrical devices may remove hair from below the surface 20 of the face.

It is preferred that the face be dried after being cleaned and/or after hair is removed from the face and prior to face mask 10 and seal 12 engaging the face.

The skin consists of three main layers: the epidermis, the dermis, and the subcutaneous tissue. The skin friendly and skin unfriendly adhesive of the present case is defined with respect to the epidermis.

The epidermis is the topmost layer of the skin and is shown in FIG. 6 as reference numeral 68. The stratum corneum (or horny layer) is the outermost layer of the epidermis and consists of mainly dead keratinocytes, hardened proteins (keratins) and lipids, all of which combine to form a protective crust. Dead epithelial cells of the stratum corneum are continuously flaked off. The skin friendly adhesive of the present invention preferably minimizes separation of the stratum corneum from the face. It is critical that the skin unfriendly adhesive of the present invention, upon a peeling off of the skin unfriendly adhesive by hand, separates the stratum corneum from the next immediate layer of the epidermis. It should be noted that some definitions of the epidermis do not include the stratum corneum as part of the epidermis. In such a case, it is critical that the skin unfriendly adhesive of the present invention, upon a peeling off of the skin unfriendly adhesive by hand, separates the stratum corneum from the epidermis or maximizes the separation of the stratum corneum from the epidermis. Preferably, the skin unfriendly adhesive is sufficiently aggressive to penetrate the stratum corneum and bond to the epidermis.

The adhesive of the seal 12 may be skin-friendly. As to a skin friendly adhesive, the Fujisawa et al. U.S. Pat. No. 6,262,330 issued Jul. 17, 2001 is hereby incorporated by reference in its entirety. In the Fujisawa et al. U.S. Pat. No. 6,262,330, a skin friendly adhesive has an adhesive strength to bakelite of at most (1.5 N)/(15 mm). Further as to a skin-friendly adhesive, the Kitazaki et al. U.S. Pat. No. 6,297,421 issued Oct. 2, 2001 is hereby incorporated by reference in its entirety. In the Kitazaki et al. U.S. Pat. No. 6,297,421, its skin-friendly adhesive has a strength of 0.6 to 10.0 N/24 mm in terms of the adhesive strength of a pressure sensitive tape 24 mm in width to a bakelite panel as measured in accordance with the 180 degree peeling method described in JIS Z 0237. The Kitazaki et al. U.S. Pat. No. 6,297,421 teaches that if the adhesive strength to the bakelite panel is too low, the adhesive strength is insufficient for human skin and if the adhesive strength to the bakelite panel is too high, disadvantages such as separation of the horny layer are easy to occur. The skin unfriendly adhesive of the present invention offers as one of its advantages the separation of the horny layer. A skin friendly adhesive causes no or minimal pain when peeled off the skin. A skin friendly adhesive minimizes the separation of corneocytes or the corneum upon peeling. A skin friendly adhesive minimizes the separation of the horny layer. When a skin friendly adhesive is peeled off the skin, little or none of the horny layer is peeled off.

The seal 12 when having a skin friendly adhesive may or may not provide protection against deadly fumes and bioterrorism and its agents such as anthrax and such uncertainty is dependent upon such factors as how wet or oily the skin is, on how much care is taken to place the skin friendly adhesive on the face, on the width of the skin friendly adhesive, and on the age or shelf life of the skin friendly adhesive. The seal 12 when having a skin unfriendly adhesive maximizes such protection and minimizes dependence upon such factors.

The adhesive of the seal 12 preferably is skin unfriendly, preferably bonds to the horny layer skin and more preferably bonds below the horny layer such as to the epidermis or to living cells of the epidermis (where the horny layer may be defined as dead cells of the epidermis), preferably is aggressive, preferably is of high-strength and preferably dries instantaneously or substantially instantaneously. A skin-unfriendly adhesive has an adhesive strength to bakelite of more than (1.5 N)/(15 mm). The skin-unfriendly adhesive of the seal 12 may have an adhesive strength of more than (1.5 N)/(15 mm) to about (20 N)/(15 mm), preferably from more than (10 N)/(15 mm) to about (20 N)/(15 mm), or more preferably from more than (10 N)/(24 mm) to about (20 N)/(24 mm) or more. As to the measurement of these ranges, the Fujisawa et al. U.S. Pat. No. 6,262,330 issued Jul. 17, 2001 and Kitazaki et al. U.S. Pat. No. 6,297,421 issued Oct. 2, 2001 are hereby incorporated by reference in its entirety. When pulled from the skin, a seal 12 having a skin unfriendly adhesive preferably removes the horny layer and more preferably removes at least some cells of the epidermis. The seal 12 when having a skin unfriendly adhesive preferably causes substantial pain when peeled from the skin.

As to an adhesive that bonds to the horny layer, the Takahashi et al. U.S. Pat. No. 6,323,275 issued Nov. 27, 2001 is hereby incorporated by reference in its entirety. It should be noted that the Takahashi et al. U.S. Pat. No. 6,323,275 does not disclose a skin friendly adhesive, but instead discloses an adhesive that has a slow bonding rate to the skin. The Takahashi et al. U.S. Pat. No. 6,323,275 also discloses how to provide an adhesive having a high bonding rate to the skin. The Hechenberger et al. U.S. Pat. No. 4,997,861 issued Mar. 5, 1991 discloses an instant adhesive having cyanoacrylate that cures rapidly and this patent is hereby incorporated by reference in its entirety. The Hickey et al. U.S. Pat. No. 6,310,166 issued Oct. 30, 2001 discloses a sterilized cyanoacrylate that is relatively thick and used for bonding tissue and this patent is hereby incorporated by reference in its entirety. Adhesives that bond to the horny layer of the skin may be selected from acrylate resins, styrene resins, polyvinyl chloride resins, polyamide resins, polyolefin resins, vinyl resins, fluorocarbon resins, polycarbonate resins, cellulosic acetate resins and thermosetting resins.

The adhesive of the seal 12, whether the adhesive is skin friendly or skin unfriendly, may be found on the face mask 10 in a tape form with a backing sheet or release that is pulled off to expose the adhesive. Or, whether the adhesive is skin friendly or skin unfriendly, the adhesive of the seal 12 may be applied from a tube directly to the band 14 of the face where the periphery 18 of the mask 10 is placed or directly to the periphery 18 or periphery face 32 of the face mask. Where the adhesive is applied from a tube, the adhesive may be spread upon the human face or the periphery 18 or periphery face 32 with the finger. Where the adhesive is spread by the finger, adhesives that take from 15 seconds to 60 seconds to 2 minutes to bond are preferred to minimize the possibility of the finger bonding to the human face or to the periphery 18 or periphery face 32 of the face mask.

The adhesive of the seal 12, whether the adhesive is skin friendly or skin unfriendly, may be a pressure sensitive adhesive.

The adhesive of the seal 12, whether the adhesive is skin friendly or skin unfriendly, may be degrade over time. As to an age-degradable adhesive, the Satterfield U.S. Pat. No. 6,179,804 issued Jan. 30, 2001 is hereby incorporated by reference in its entirety.

The adhesive of the seal 12, whether the adhesive is skin friendly or skin unfriendly and whether the adhesive sticks to the skin or to the periphery of the face mask, is preferably elastomeric in its set form to compensate for movement of the face such as when the user of the mask 10 talks or yells. Such adhesives may be rubber-based adhesives. As to an adhesive that is at least weakly elastic, the Poulsen et al. U.S. Pat. No. 4,367,732 issued Jan. 11, 1983 is hereby incorporated by reference in its entirety.

Where the adhesive of the seal 12 is skin friendly, the seal 12 may be simply pulled off the face. Where the adhesive of the seal 12 is skin unfriendly, solvents such as household rubbing alcohol (70% isopropyl rubbing alcohol), acetone, methyl ethyl ketone may be used to dissolve a great majority of adhesives that bond to the horny layer of the skin. Still further, medical scraping apparatus may be used to remove the skin unfriendly adhesive. As to a medical scraping apparatus, the Gusakov et al. U.S. Pat. No. 5,803,639 issued Sep. 8, 1998 is hereby incorporated by reference in its entirety. Still further, the skin unfriendly adhesive may be permitted to flake away as the underlying skin cells of the epidermis die and flake away, which is a natural process. It may take about three to five weeks for the skin unfriendly adhesive and the underlying skin cells to flake away.

The covering 16 of face mask 10 preferably is a filter that permits air to pass through but which traps particulates. The particulates may be smoke particulates or anthrax or other relatively small substances.

The covering 16 includes a portion that projects outwardly of the mouth. This portion is within the periphery 18 and is convex relative to an exterior of the covering 16. This type of covering 16 having such a convex portion is preferred. With such a convex portion, the covering 16 is spaced from the mouth and away from spit and saliva that may degrade the mask. Further, spit and saliva is a fluid that may permeate or move through the covering 16, dissolve the toxin, and then move back through the covering 16, drawing the toxin with it. Further, spit and saliva may reduce the potential of any neutralizing agent in the covering 16 to neutralize a toxin as the spit and saliva may dilute the neutralizing agent or block the activated portions of the neutralizing agent from gaining access to the toxin.

Figure 2A:
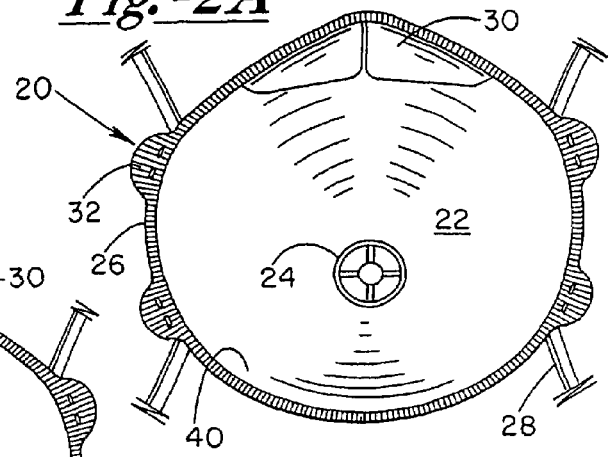
FIGS. 2A–D shows how strips of tape may be engaged to a face mask to form a seal.

FIGS. 2A–D show how a nonsealed face mask can be converted quickly to a sealed face mask. As shown in FIG. 2A, a face mask 20 includes a generally concave covering 22, where the covering 22 is concave from the perspective of FIGS. 2A–D. The covering 22 includes a one-way valve 24 that permits air (one's breath) to exit the face mask 20 but does not permit air into the covering 22 so as to force air through the covering or filter 22. Face mask 20 further includes a periphery 26, binders or straps 28 for being engaged about the ears or about the back of the head for holding the face mask 20 in place over the nostrils and mouth, and nose flaps 30 for providing a greater comfort or seal about the nose. It should be noted that the covering 22 may be semi-rigid or rigid and that the covering 22 may be formed of paper or plastic. It should be further noted that the periphery 26 includes a face 32 that is ribbed.

Figure 2B:
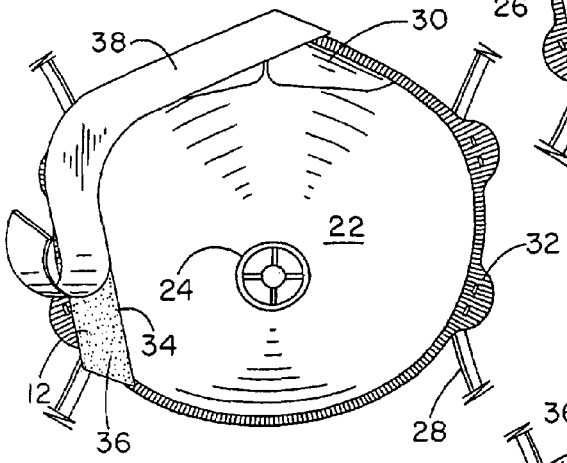

As shown in FIG. 2B, a seal 12 includes an elongate base 34 having a pair of adhesive faces 36 that are exposed when a release or backing elongate strip 38 is removed from the face 36 having the adhesive. One adhesive face 36 is on one side of the base 34 for engaging the skin of the face. The other adhesive face 36 is on the other side of the base 34 for engaging the periphery 26 of the face mask 20.

It should be noted that the adhesive 36 for engaging the skin may be of relatively greater, relatively lesser or of relatively equal strength to the adhesive 36 for engaging the periphery 26 of the face mask 20. In other words, for some operations, it may be desirable to pull the face mask 20 off the base 34, which remains affixed to the face, and onto which another face mask 20 having another seal 12 is affixed such that two seals 12 are engaged between the face mask 20 and the face. This method may be employed when a skin unfriendly seal is used and when the wearer of the face mask 20 must drink or eat. With this method, the strength of the adhesive relative to the face is greater than the strength of the adhesive relative to the periphery 26 of the face mask 20. For other operations, it may be desirable to pull the face mask 20 and the base 34 off of the face. This method may be employed where a skin friendly adhesive is used and where one imagines that a lesser risk to one's health exists. With this method, the strength of the adhesive relative to the face is less than the strength of the adhesive relative to the periphery 26 of the face mask 20.

The base 34 is preferably formed of a polymer or copolymer and is preferably at least weakly elastic along all three axis to respond to movements of the face generated by talking or yelling and to isolate such movements from the paper or plastic covering 22. Further, the periphery 26 and/or the covering 22 may be at least weakly elastic along all three axis to accommodate movements of the face generated by talking or yelling.

The base 34 is preferably at least weakly deformable so as to be pushable into and set within the ribs of the face 32 of the periphery so as to minimize any openings remaining between the base 34 and the periphery 26. The base 34 is preferably of a width greater than the width of the periphery 26. With such a great width, a portion of the adhesive face 36 engages the periphery 26 and another portion of the adhesive face 36 engages a nonribbed relatively smooth peripheral edge portion 40 that is beginning to run obliquely toward the valve 24. By engaging a relatively smooth portion, instead of a rough or ribbed portion, of the face mask 20, chances are maximized that an absolute seal is established.

As further shown in FIG. 2B, base 34 (that may be originally provided as a stand alone piece of elongate tape that includes elongate base 34, a pair of adhesive elongate faces 36, and a pair of release or backing elongate strips 38 over the adhesive faces 36) runs for less than 360 degrees about the periphery 26. A base 34 or piece of tape running for less than 360 degrees about the periphery 26 is preferred for a number of reasons. First, pieces of tape of a variety of shapes and sizes may fit a greater variety of face mask peripheries. Second, there are too many risks where the only base or tape that is provided is one that exactly matches the periphery 26. One risk is that the periphery of the paper or plastic face mask has been damaged or bent. How does one match a perfect seal with an imperfect periphery? Another risk is that the perfect 360 degree tape that is to provide the seal has been damaged. How does one make up for one or two or ten degrees that has been lost? Of course, one base 34 that may be provided is one that perfectly matches the periphery 26. However, a base 34 or piece of tape that runs for less than 360 degrees minimizes such risks.

It is further preferred that the base 34 or piece of tape is angular, such as in the shape of a "V" as shown in FIG. 2B. By providing an base 34 shaped angularly, the base 34 neatly fits the curvature of the periphery 26 (which is a curvature in first plane). Moreover, by providing a base 34 that is shaped angularly, base 34 better fits the curvature of a face (which is a curvature in a second plane different from the first plane mentioned above).

Figure 2C:
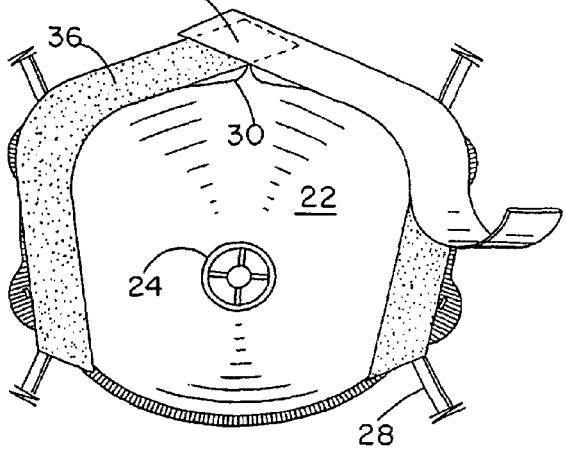

As shown in FIG. 2C, a second elongate base 34 is placed on another portion of the periphery 26 so as to overlap a portion of the first base 34. The overlap is indicated by reference number 42.

Figure 2D:
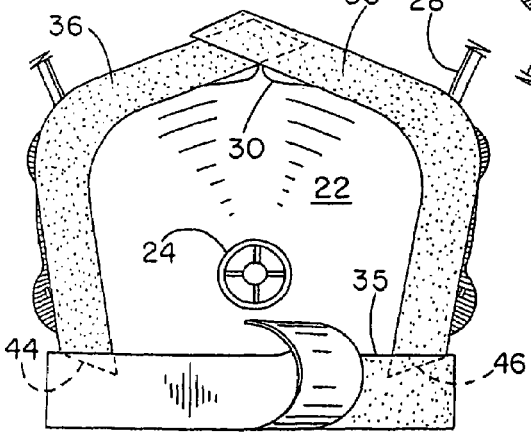

As shown in FIG. 2D, a third elongate base 35 is placed on the remaining portion of the periphery 26 so as to overlap a portion 44 of the first base 34 and a portion 46 of the second base 34. Accordingly, the entire periphery 26 of the face mask 20 has the seal 12. Face mask 20 is thereby ready to be pressed onto band 14 of the face.

It should be noted that each of bases 34 and 35 is relatively wide. Accordingly, linear base 35 engages and completely seals a curved portion of the periphery 26. Likewise, even though bases 34 do not exactly match the angles or curvature of the periphery 26, the relatively great width of bases 34 permit the bases 34 to completely seal their respective portions of the periphery. The width of the bases 34 and 35 is preferably between one centimeter and three centimeters, and more preferably between one and one/half centimeters and three centimeters. Such a width permits the bases 34 and 35 to capture and seal a curved portion of a periphery of a relatively great length.

It should be noted that a piece of tape having base 34 can be stored with the mask 20. When the mask 20 is needed, one elongate release strip 38 is peeled from its respective adhesive face 36 and this adhesive face 36 is set on the periphery 26. Then a finger or thumb is placed on the opposing release elongate strip 38 still remaining on the base 34 and this finger or thumb then applies pressure onto the opposing release elongate strip 38 to bring pressure to bear on the base 34, in turn on the adhesive face 36 engaging the periphery 26, and in turn on the ribbed face 32 of the periphery so as to push and deform partially at least one of the base 34 and ribbed face 26 so as engage valleys as well as peaks of the periphery 32. Then the remaining elongate release strip 38 is pulled of the base 34 and other pieces of tape, as shown in FIGS. 2C to 2D can be engaged in the same manner on the periphery 26.

Figure 3A:
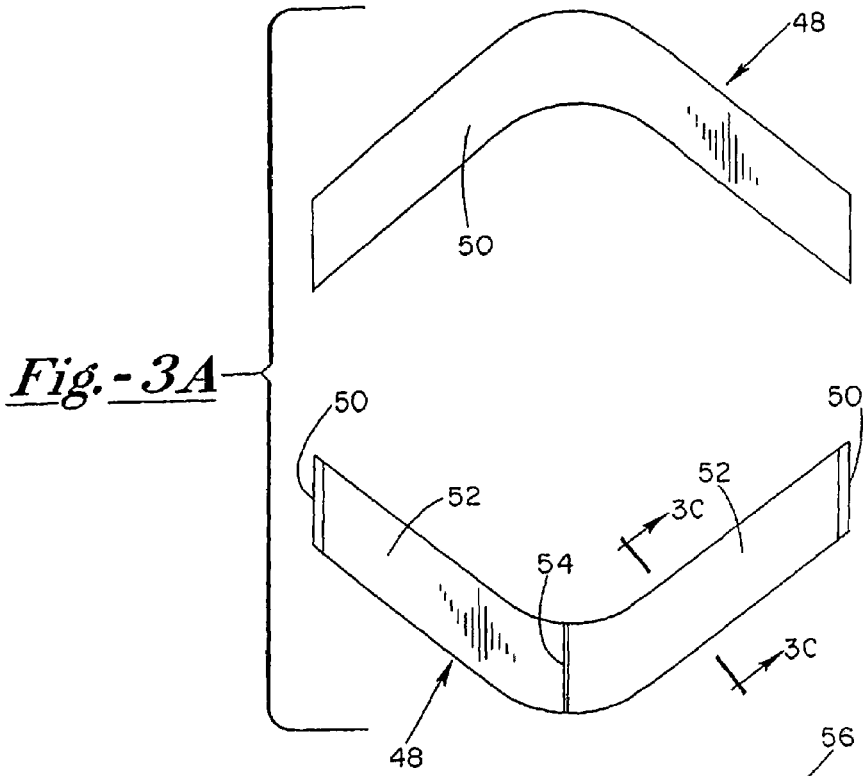
FIG. 3A shows two relatively large strips of tape having a paper release and a plastic release.

FIG. 3A shows the front and back sides of one preferred piece of tape 48. One side of the piece of tape 48 includes a singular paper release strip 50. The other side of the piece of tape 48 includes a pair of plastic release strips 52 separated by a slit 54. Easy peeling of release strip 50 is provided by extending release strip 50 beyond release strip 52. Easy release of strips 52 is provided the provision of the slit 54 into which a fingernail can be pushed so as to initiate a peeling action of one of the release strips 52.

It should be noted that both release strips 50 and 52 may be formed of paper. Or both release strips 50 and 52 may be plastic. Whether a release is paper or plastic may depend upon the type of adhesive that is used. Paper release strip 50 is relatively porous. Plastic release strip 52 is relatively nonporous. As noted above, the type of adhesive that can be used varies. For example, the adhesive may be skin friendly, at least weakly elastic, pressure-sensitive and/or degradable over time. More preferably, the adhesive is skin unfriendly, at least weakly elastic, pressure-sensitive and/or degradable over time.

Figure 3B:
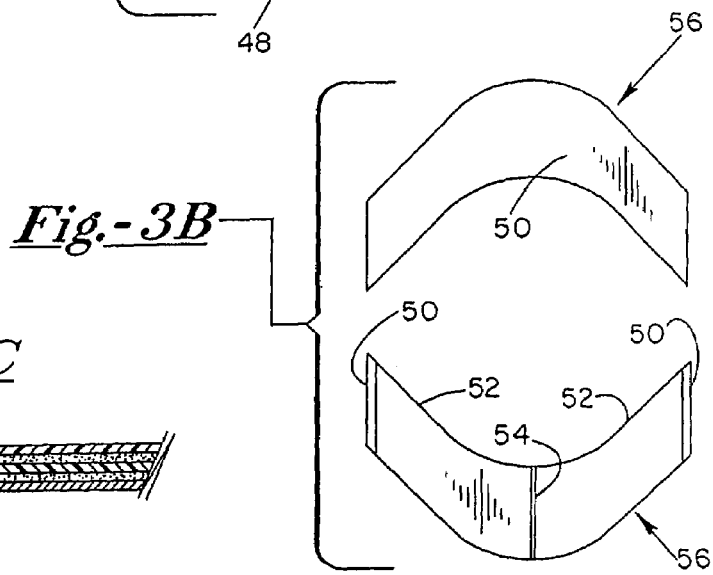
FIG. 3B shows two relatively small strips of tape having a paper release and a plastic release.
Figure 3C:
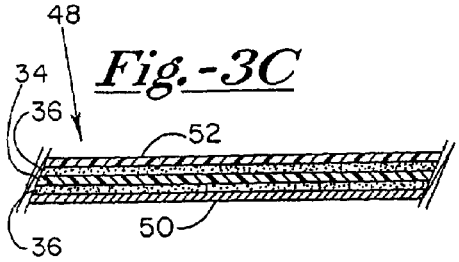
FIG. 3C shows a section of a strip of tape having a paper release on one side and a plastic release on another side.

FIG. 3B shows a piece of tape 56 that is identical to piece of tape 48 shown in FIG. 3A, except that the piece of tape 56 is relatively small. Again, a piece of tape that extends for 360 degrees and that matches a periphery of a mask may be included in any kit for making a sealed face mask. However, pieces of tape having a different size, such as pieces of tape 48 and 56 are preferably included in a kit. Further preferably included in a kit are pieces of tape having a different shape, such as pieces of tape 48 and the piece of tape for linearly extending base 35 shown in FIG. 2D.

Figure 4A:
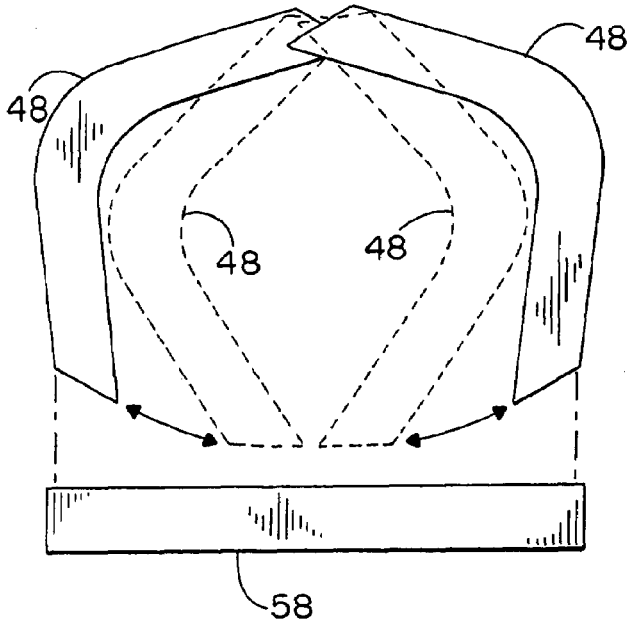
FIG. 4A shows how tapes of different sizes and shapes may be adjusted to match a periphery of a face mask.
Figure 4B:
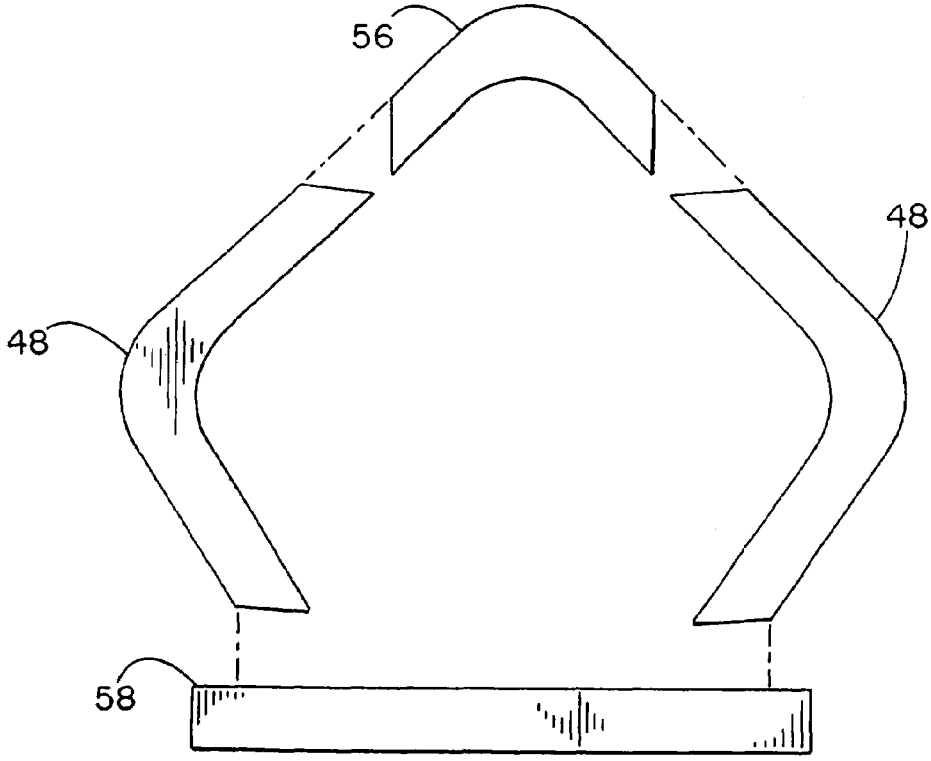
FIG. 4B shows how tapes of different sizes and shapes may be adjusted to match a periphery of a face mask.

The capabilities of such kits are shown in FIGS. 4A and 4B. For example, a kit may be provided that has a linearly extending piece of tape 58 (that includes base 35), two pieces of tape 48, and a relatively small piece of tape 56. Accordingly, such a kit having different shapes of tape and different sizes of tape may seal a periphery of a face mask having a shape as shown by solid lines in FIG. 4A, or having a shape shown by phantom lines in FIG. 4A, or having a shape as shown in FIG. 4B. In FIG. 4A, the phantom lines show that pieces of tape 48 may provide a seal 12 for a relatively small mask, as for a child, by overlapping the ends of each of the pieces of tape 48 so a to provide a diamond shape.

The provision of seal 12 forces air through the covering or filter 16 of the face mask 10. Covering or filter 16 preferably has a neutralizer engaged therein. For example, as shown in FIG. 5A, covering or filter 16 includes a front layer 60 and a rear layer 62 that are sealed relative to each other at a perimeter edge 64. Sandwiched between the layers 60 and 62 is a layer of a neutralizer 66. Accordingly, with a sealed face mask, air taken in by a user must pass through the neutralizer 66. Neutralizer 66 may be a layer of activated carbon or some other neutralizing agent. It should also be noted that the neutralizing agent may be integral or one piece with the material forming the covering such that only one layer of covering can be used. As to a neutralizer for poisonous gas and as to producing coverings with neutralizing agents, the Nishino et al. U.S. Pat. No. 5,400,780 issued Mar. 28, 1995 is hereby incorporated by reference in its entirety. As to a neutralizer for dust, virus, bacteria, fungus, pollen, the Nakajima et al. U.S. Pat. No. 5,143,752 issued Sep. 1, 1992 is hereby incorporated by reference in its entirety.

FIG. 5A shows that the neutralizer 66 extends from a top to a bottom of the mask 10. FIG. 5B shows that the neutralizer 66 extends from a right side to a left side of the mask 10. Hence, any air passing through the covering 16 passes through the neutralizer 66.

FIG. 6 shows the surface 20 of a human face, a first layer of skin 68, and a hair 22 that has been cut or dissolved to a level below the surface 20 of the human face. FIG. 6 further shows a hair 70 that has not been cut or dissolved or removed such that hair 70 may provide an opening 72 through the seal 12 through which smoke or biotoxins or other terroristic agent may enter.

Figure 7A:
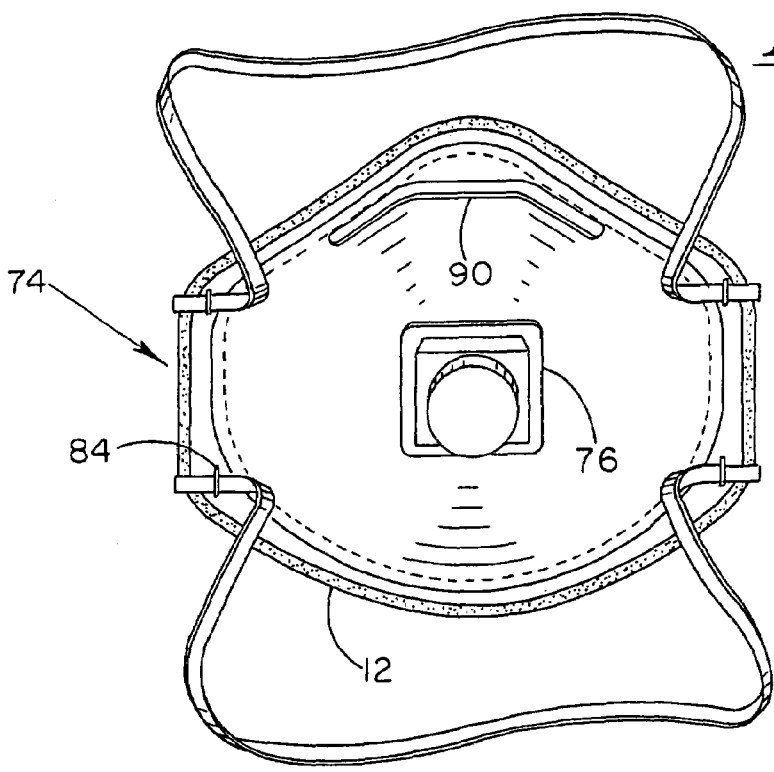
FIG. 7A shows one type of face mask having the seal of the present invention.
Figure 7B:
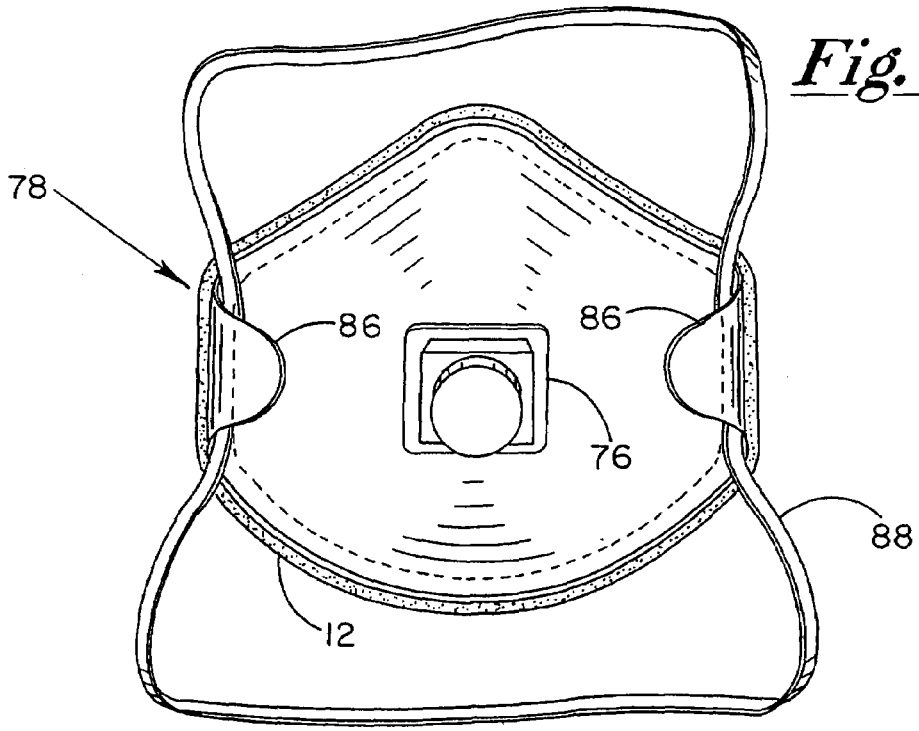
FIG. 7B shows another type of face mask having the seal of the present invention.
Figure 8A:
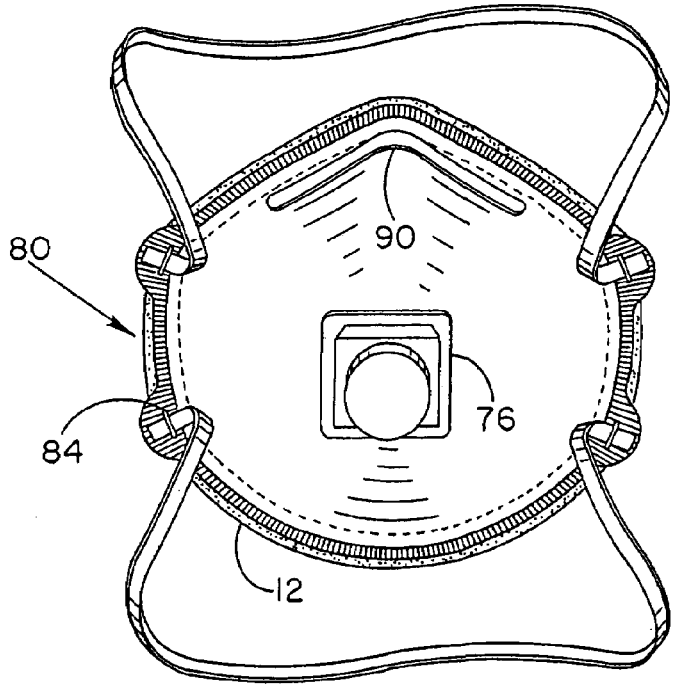
FIG. 8A shows still another type of face mask having the seal of the present invention.
Figure 8B:
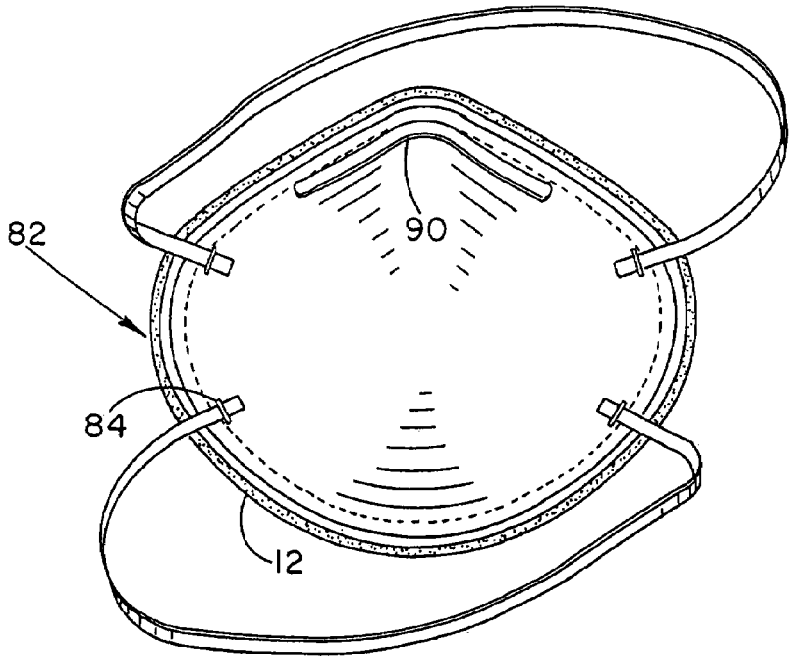
FIG. 8B shows yet another type of face mask having the seal of the present invention.

FIGS. 7A–7B and 8A–8B show different configurations of face masks. Face masks 74, 78 and 80 in FIGS. 7A, 7B and 8A have one way valves 76 to let air out but which cannot take air in. Valves, even one way valves, are not preferred because mechanical valves may fail and because mechanical valves may not close sufficiently quickly to bar the intake of bioterroristic or toxic agents. A mask having no valve, such as mask 82 shown in FIG. 8B, is preferred over a mask having a valve.

Face masks 74, 80 and 82 in FIGS. 7A, 8A and 8B have straps that are stapled to the coverings of the masks via staples 84. Staples 84 are not preferred. Staples 84 poke holes through the coverings that may permit biotoxins or other terroristic agents to flow through the coverings of the masks. Even if the staples 84 or staple holes are sealed with the seal 12, staples may tend to poke through the seal 12. The provision of rigid, inwardly extending ears 86 and the provision of a single resilient looped binder strap 88, as shown in FIG. 7B, is preferred over staples 84 so as to maintain the integrity of the covering. A binder strap, such as binder strap 88, may maintain a pressure on the face mask until the adhesive of a seal 12 cures.

It should be noted that face masks 74, 80 and 82 have deformable metal strips 90 to be pressed about the nose.

Figure 9:
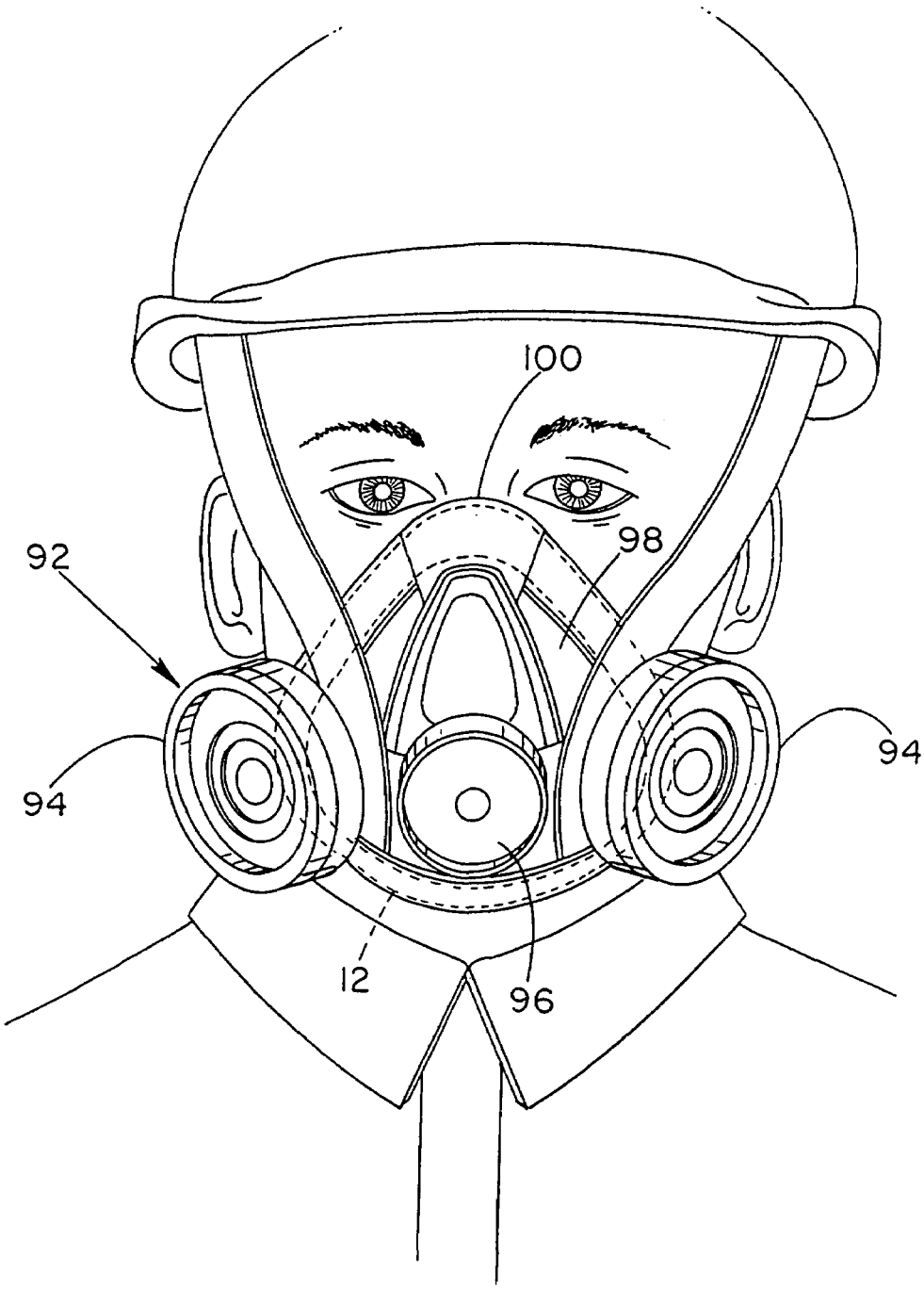
FIG. 9 shows an active face mask or respirator.

An active face mask or respirator or gas mask 92 is shown in FIG. 9. Mask 92 has a pair of one way valves 94 for air intake. Another valve 96 is one way for the exhalation of air. Mask 92 further includes a covering 98 having a rubber or elastomeric periphery 100 for being pressed against a face. The rubber or elastomeric periphery 100 may have the seal 12 of the present invention. The seal 12 is shown in phantom in FIG. 9. A positive air pressure exists within active face mask 92 of about three to four pounds. The conventional purpose of the positive pressure is to guard against the flow of smoke or other fluid or substance into the mask, whether such an inward flow would be about the periphery 100 or through a leak somewhere in the mask. With the seal of the present invention, air (such as in a tank on the back of the user) is conserved. That is, less air is lost flowing out of the mask 92 via the periphery 100. However, there is still a positive pressure within the mask 92 to force air through any leaks in the sealed periphery 100 or any leaks elsewhere.

Figure 10:
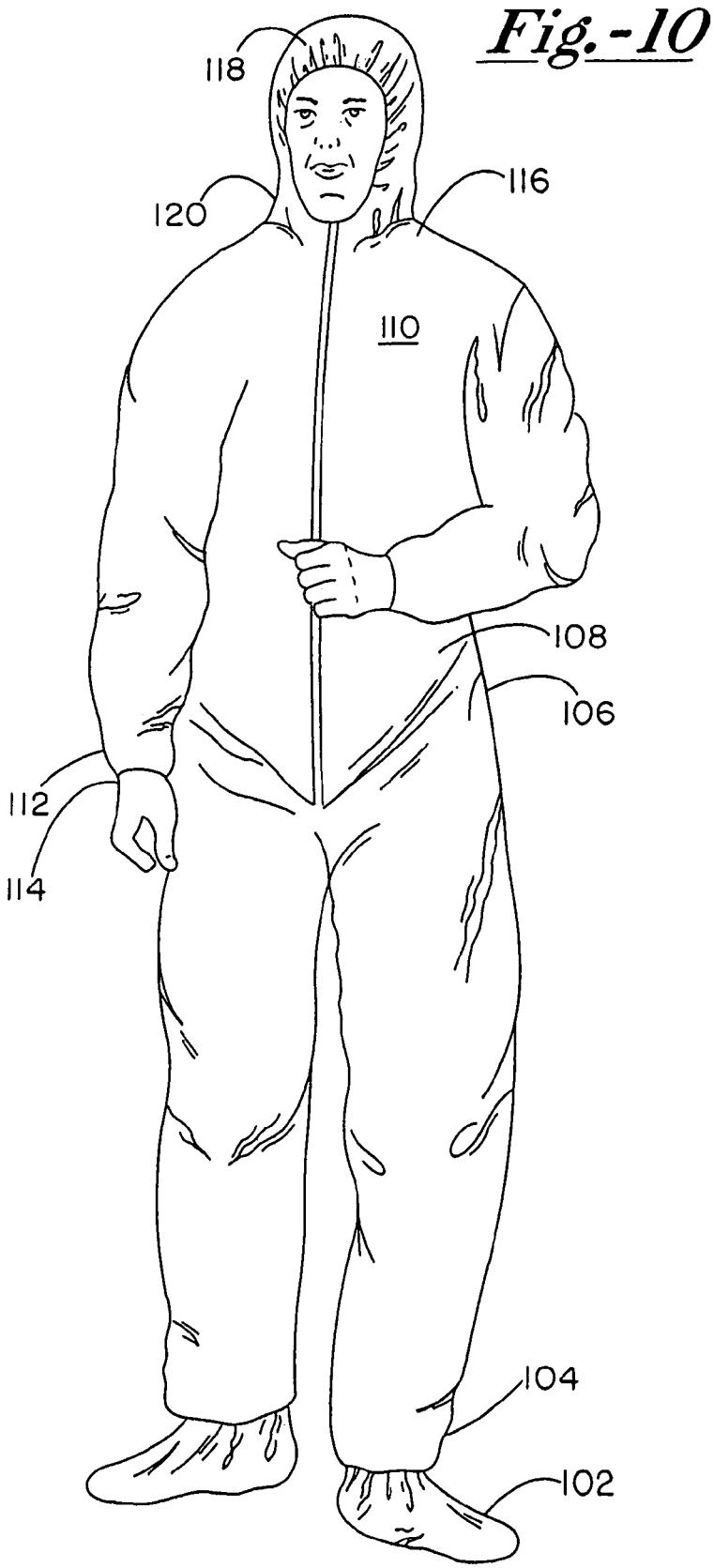
FIG. 10 shows a person suited for work such as decontamination and indicates areas where the seal of the present invention may be utilized.

With bioterroristic agents, it is preferable if the whole body is sealed. However, the person on the street normally does not have clothes that perfectly seal him or her from bioterroristic agents. The present invention includes a kit having tapes of different sizes and shapes. One such kit is a kit having pieces of tape 48, 56 and 58. Using only such a kit having a plurality of these pieces of tape, a whole body can be sealed whether the clothing available is high tech hazardous waste type clothing or the conventional cotton, wool, polyester or rayon or other fiber based clothing typically worn. For example, as shown in FIG. 10, a person may seek to seal an opening of footwear 102 at the ankles, a pant leg opening 104, a waist opening 106 of a pair of pants, a lower or waist opening 108 of upper body wear 110, a sleeve opening 112, a glove opening 114, a neck opening 116 of upper body wear 110, a hood opening 118, and a neck opening 120 of a hood. Each of these openings may be sealed utilizing the adhesive and/or pieces of tape (such as linear piece of tape 58) of the present invention. Each of these openings may be sealed directly against the skin or directly against another article of clothing utilizing the adhesive and/or pieces of tape (such as one or more linear pieces of tape 58) of the present invention. Further, the methods of the present invention as to the sealed face mask may be employed as to other parts of the body. For example, the features of the seal of the present invention may be utilized here to provide a skin friendly or skin unfriendly seal. Also, the features of the methods to remove hair to a level below the top surface of the face may be employed here at the leg, hand, arm, waist or neck regions.

Figure 11A:
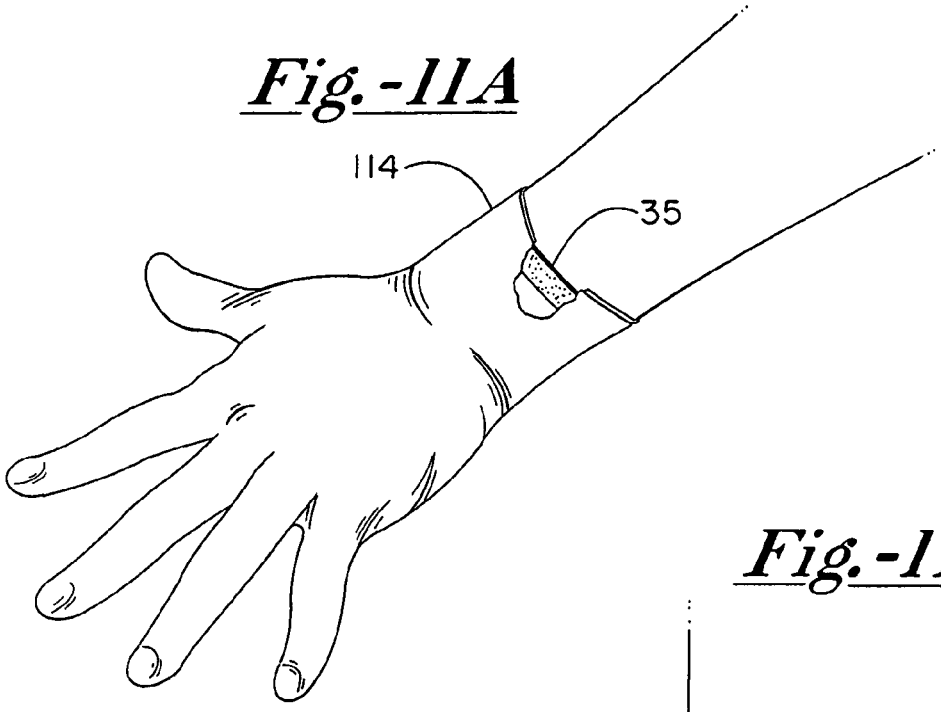
FIG. 11A shows a glove sealed to the skin of the wrist.

As shown in FIG. 11A, a glove or hand wear opening 114 may be sealed with several pieces of tape 58 (having base 35) relative to a sleeve or to the skin of the forearm or wrist. Another type of hand wear is a mitten.

Figure 11B:
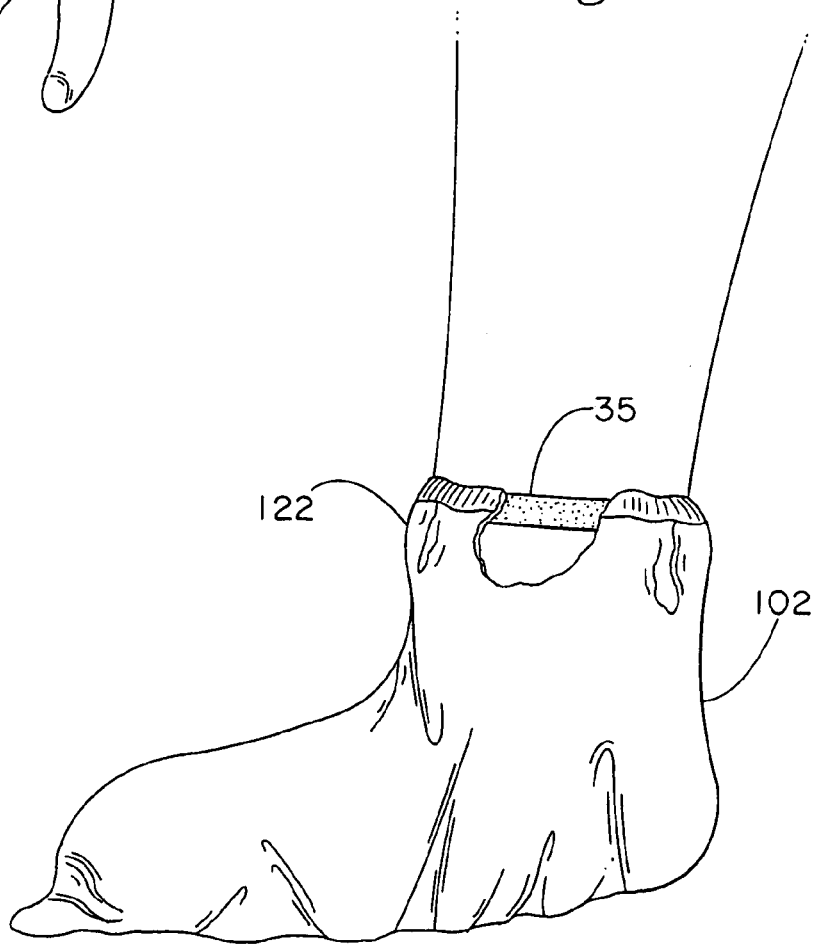
FIG. 11B shows footwear sealed to the skin of the ankle.

As shown in FIG. 11B, footwear 102 having an opening 122 may be sealed using several pieces of tape 58 (having base 35) relative to the skin of the ankle or to the lower end of a leg of a pair of pants or to a sock. Footwear 102 may be a bootie, a shoe, a boot or some other type of footwear.

Figure 12A:
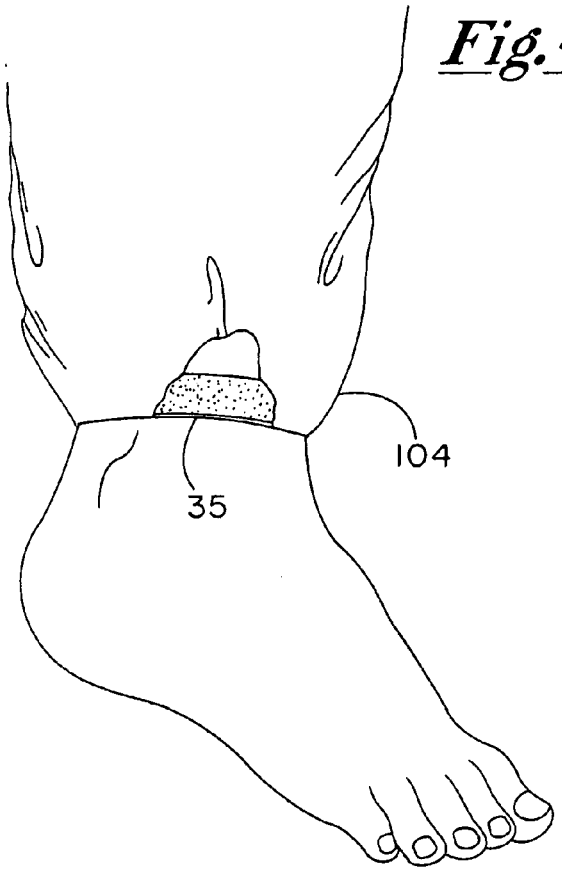
FIG. 12A shows a pants' leg sealed to the skin of the ankle.

As shown in FIG. 12A, lower opening 104 of a pair of pants may be sealed using several pieces of tape 58 (having base 35) relative to the skin of the ankle or to a sock or to a footwear such as a pair of boots.

Figure 12B:
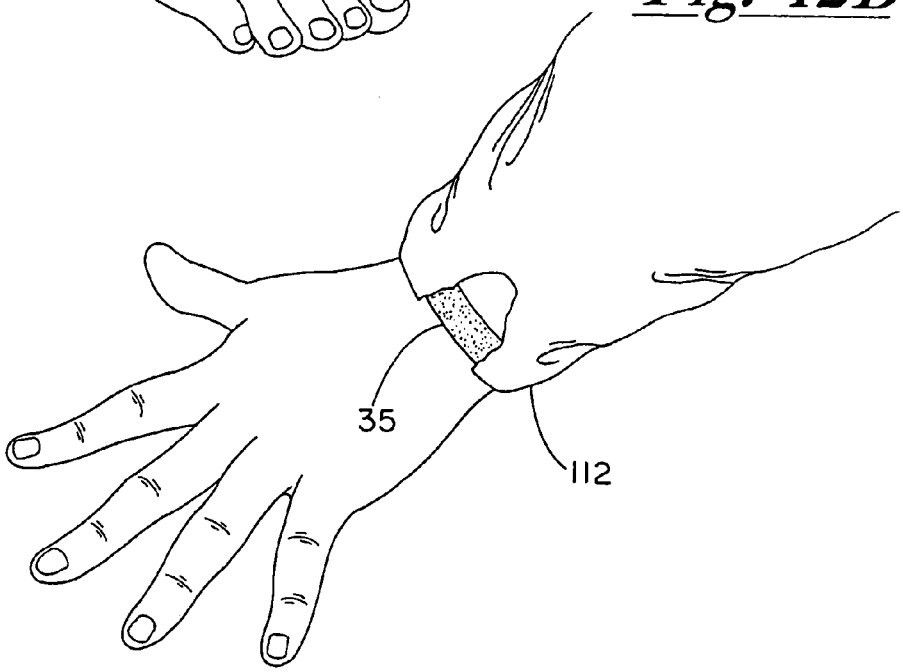
FIG. 12B shows a sleeve of upper body wear sealed to the skin of the wrist.

As shown in FIG. 12B, a sleeve opening 112 may be sealed using several pieces of tape 58 (having base 35) relative to the skin of the wrist or to a glove or other hand wear.

FIG. 13A shows a hood 124 having a neck opening 120 that may be sealed using several pieces of tape 58 (having base 35) relative to the skin of the neck or a neck piece of upper body clothing 110. Hood 124 completely encapsulates the head and includes a face shield 126, an outlet one way valve 128, and a filter or covering 130 for air intake. Filter 130 preferably includes the neutralizer 66 of the present invention.

FIG. 13B shows upper body wear 110 for the torso that has a neck opening 116. Neck opening 116 may be sealed using several pieces of tape 58 (having base 35) relative to the skin of the neck or relative to neckwear of a headpiece.

In other words, the present invention includes an apparatus for sealing a portion of the body, wherein the apparatus includes a set of strips of tape such as tape 48, 56 and 58, wherein each of the strips of tape 48, 56 and 58 includes a base 34 (or base 35) having first and second adhesives or adhesive faces 36 and release strips 38 over the adhesive faces 36, wherein the first adhesive is adaptable to stick to an article selected from the group of cloth articles, fabric articles and plastic articles, and wherein the second adhesive is skin unfriendly such that when peeled by hand off the skin the horny layer of skin is peeled off the epidermis whereby the tape aggressively seals the article to the skin. The article may be a face mask, footwear such as socks or shoes, hand wear such as gloves or mittens, a pair of pants or other leg wear, upper body wear for the torso such as a jacket or shirt or sweat top, or a hood.

Accordingly, one method of the present invention includes the method of sealing the mouth and nose with the present sealed face mask, and/or sealing foot wear such as socks or shoes at the ankle, and/or sealing a pair of pants at the bottoms of the pant legs, and/or sealing the pair of pants at the waist of the pants, and/or sealing a shirt or upper body wear at the waist, and/or sealing a shirt or upper body wear at the ends of the sleeves of the shirt, and/or sealing hand wear at the wrists, and/or sealing a shirt or upper body garment at the neck, and/or sealing a hood at the neck.

It should be noted that FIGS. 1A–B, 2A–D, 5A–5B, 7A–B, 8A–B, 13A show passive face masks. Air is drawn into the passive face mask by the user of the passive face mask.

Figure 14:
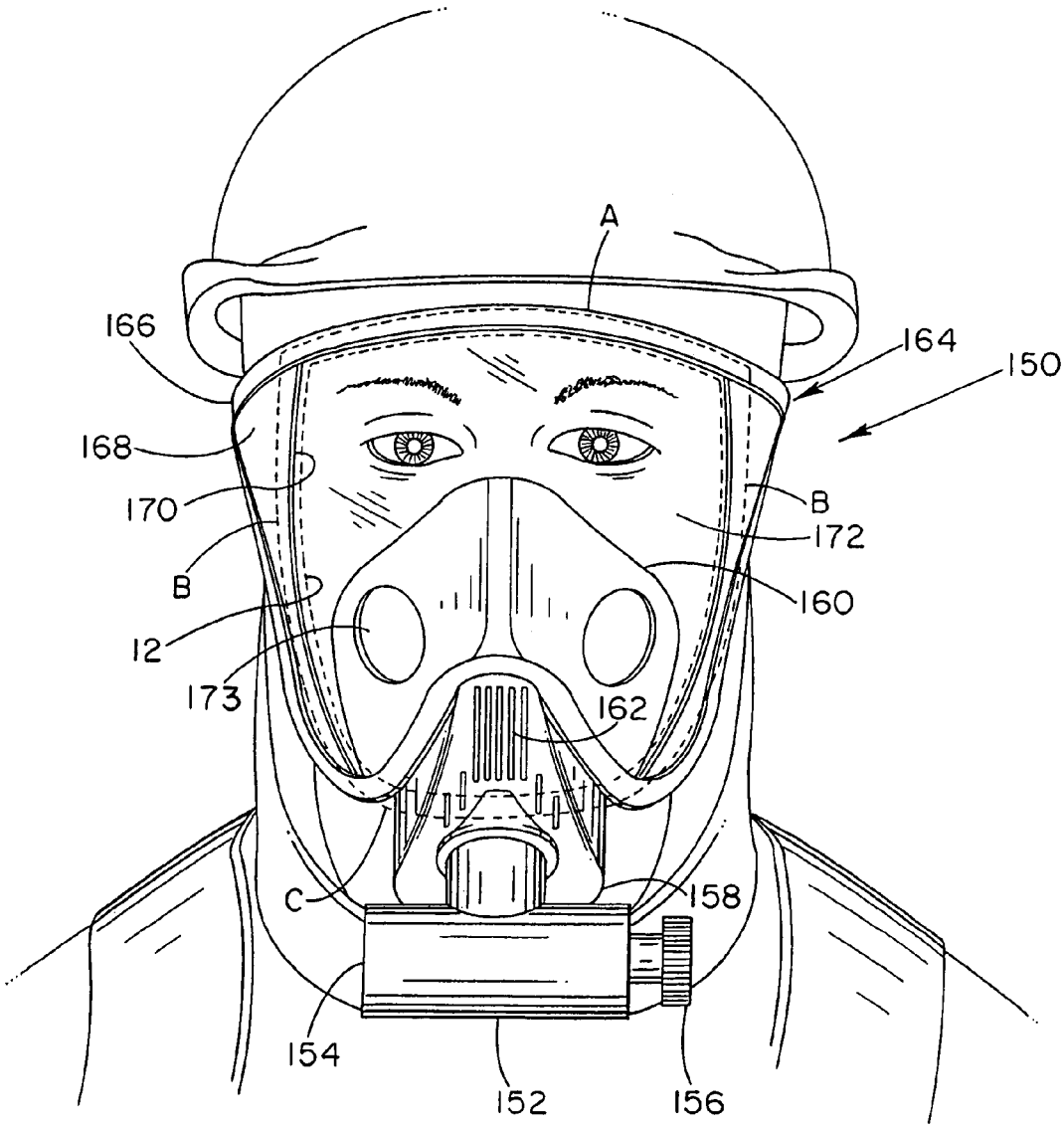
FIG. 14 shows an active face mask or respirator.

It should be noted that FIGS. 9 and 14 show active face masks or respirators. FIG. 14 shows an active face mask or respirator or gas mask 150. Active face mask 150 includes an air intake T-connection 152 having an air intake coupler end 154 and an air intake valve 156. The T-connection 152 is engaged to an air exhaust piece 158 and is further engaged to a nose and mouth piece 160 that confronts the mouth and nose. The combination of the air exhaust piece 158 and nose and mouth piece 160 is a base unit that includes a valve arrangement that permits fresh air into the nose and mouth piece 160 via the T-connection 152 and permits exhaled air out of the nose and mouth piece 160 and out of the mask 150 via the air exhaust piece 158. A face shield 164 is engaged to the base unit of the air exhaust piece 158 and nose and mouth piece 160 via a base hard plastic strip 166. The relatively rigid base strip 166 runs about the periphery of the face shield 164. The base strip 166 forms the shape of an inverted U between the nose and mouth piece 160 and the air exhaust piece 158. The base strip 166 runs upwardly from the inverted U shape to be disposed along the each of the sides of the face to a position near the ears so as to form a W shape. Then the base strip 166 runs inwardly from the ears and across the forehead. A clear plastic shield 172 is engaged to the outer face of the base strip 166. The face shield 164 further includes a rubber or elastomeric piece 168 (a resilient piece 168) that is engaged to the inner face of the base strip 166 except for the inverted U-shaped portion of the base strip 166, where the resilient piece 168 is engaged to an underside of the unit having the exhaust 158 and the mouth and nose piece 160 and where the resilient piece 168 cradles the chin. The resilient piece 168 thereby extends completely about the eyes, mouth and nose as a whole. The resilient piece 168 is relatively wide at the sides of the face. The resilient piece 168 includes an eye, nose and mouth opening defined by an inner edge 170 that completely surrounds the eyes, nose and mouth. The air exhaust piece 158 is generally external to the clear plastic shield 172 and the nose and mouth piece 160 is internal to the clear plastic shield 172. The nose and mouth piece 160 includes vents 173 from which air flows to the inner face of the clear plastic shield 172 to minimize formation of a condensate or fog on the inner face of the clear plastic shield 172. The seal 12 of the present invention is engaged to the active face mask 150 between the face and the resilient piece 168 as shown in phantom lines in FIG. 14. The seal 12 is engaged at a position A (between the face and the portion of the resilient piece 168 that is engaged under a portion of the base strip 166 that runs across at least a part of the forehead), at two positions B (between the face and the inner edge 170 of each of the right side and left side portions of the resilient piece 168), and at a position C (between the face and the portion of the resilient piece 168 that cradles the chin). The seal 12 runs continuously from position A to position B to position C to position B to position A to run continuously about the eyes, nose and mouth as a whole. As with the active face mask of FIG. 9, face mask 150 permits air to be conserved by the user (such as a fireman or diver). Conventionally, air is slowly lost about portions of the strip 166 and resilient piece 168 because of the positive air pressure of about three or four pounds inside of the mask 150. Conventionally, this loss of air is intended to guard against an inflow of smoke or other fluid. With the seal 12, the positive air pressure is maintained to guard against inflow yet less fresh air from a tank is required, thereby providing the fireman or firewoman more time inside a smoke filled environment.

The Poulsen et al. U.S. Pat. No. 4,367,732, incorporated by reference above, discloses the following:

> The adhesive layer is deformable under the influence of weak and rapidly acting forces, thus having a low elasticity modulus and a large elongation. It has a very low flowing when dry and not exposed to outer forces. With the expression that the elastomer must be physically cross-linked is meant that the cross links in the polymer of which it consists is not of a chemical (covalent) nature but of a physical nature which means that there are areas or domains within the elastomer which have a high crystallinity, i.e. a high glass transition temperature. Precisely this property of the material known from U.S. Pat. No. 4,231,369 causes that when absorbing moisture it expands largely uniformly in all three dimensions. It has surprisingly been found that a limited plastification of the physical cross-links in the elastomer with the plasticizer mentioned under (c), which must be compatible with the styrene domains of the elastomer, causes that absorption of moisture in the adhesive material in use precominantly expresses itself as an increase in dimension in the thickness direction and only very small expansion in the two other dimensions. Thereby the puckering of the adhesive material, discussed hereinabove, is avoided even at high moisture absorption, and hence also that the adhesion gets lost in parts of the adhesive material. Especially it is obtained that sealing problems when using the material for ostomy adhesive and sealing gaskets are avoided. The lesser elasticity and higher plasticity of the material caused by the plasticizer, which may give a tendency to some degree of permanent change of shape or "set" after deformation is counteracted thereby that the watertight film is elastic, whereby the combination adhesive layer-film has the desired properties with respect to a low elasticity modulus and a small or no permanent change of shape or "set" after deformation.

Because of this the skin barrier according to the invention is not only suited as sealing and adhesive gasket for ostomy pouches and other ostomy closure means, but also for bandaging purposes where skin, mucous membranes or wounds are to be protected against the immediate surroundings such as intestinal, wound or glandular secretions or again bacterial attack, the action of the air, evaporation, light, impact and pressure. If the skin barrier is to be used in connection with real bandages change of these may take place without disturbing the surface of the skin or wound since the skin barrier is retained on the skin at the change, and moreover it will in itself limit bandage changes to a minimum. The material is skin and wound friendly and because of the elastic properties it may in many cases draw edges of wounds together and render superfluous the use of clips, which may give a less visible wound healing than would otherwise be the case. By use around movable parts of the body, e.g. joints, or on soft parts of the body, which for instance are apt to form folds, the mobility is preserved and the skin barrier follows the movements. The skin barrier seals well around protruding part of the body, e.g. ostomies.

As elastomer there is used as mentioned styrene-olefin-styrene block copolymers. They are A-B-A block copolymers having polystyrene end blocks which are thermodynamically incompatible with the polyolefin rubber middle blocks. Consequently there is phase separation in the solid state. The polystyrene constitutes about a third of the molecule and hard polystyrene domains are therefore a kind of discontinuous phase distributed in a rubber matrix. The hard areas constitute the physical cross-links which bind the ends of the molecules together to a network reminding of that formed by a conventional vulcanized rubber (caoutchouc). Since the high cohesive strength of the block copolymer originates from the physical cross-links (instead of from the chemical cross-links as in vulcanized materials) it is easy to work. In comparison with conventional rubbers the styrene-olefin-styrene block copolymers have low molecular weights, of the A-blocks around 2000–100,000 and of the B-blocks around 25,000–200,000. The content of styrene units is normally below 40%. These block copolymers have two glass transition temperatures, one below, the other considerably above room temperature.

The aliphatic blocks may be based on isoprene, butadiene, other short chain alkadienes or alkenes such as mixtures of ethylene and butylene, or polyisobutylene. It has been found according to the invention that the elastomer particularly advantageously is a styrene-isoprene-styrene block copolymer. Very suitable is the material sold under the registered trade mark "Cariflex" Tr-1107, which contains about 28% by weight styrene units.

The proportions of the several components may vary within rather wide limits. The amount of the elastomer, however, is normally somewhat higher than in the material known from U.S. Pat. No. 4,231,369 and according to the invention constitutes 10–40% by weight of the adhesive layer, preferably 20–40%. According to the invention the composition of the adhesive layer expressed in % by weight may be: elastomer 10–40%, preferably 20–40%; tackifier resin 15–45%, preferably 30–40%; plasticizer for the two domains of the elastomer as defined 2–12%, preferably 8–12%; antioxidant 0.5–2.5%; oily extender 0–25% and hydrocolloid 10–55%, preferably 20–40%.

An especially preferred composition is about 25% styrene-isoprene block copolymer (notably one containing about 20% styrene unites, "Cariflex" ® TR 1107), about 35% tackifier resin, about 9% dioctyl adipate, about 1% antioxidant and about 30% sodium carboxymethylcellulose.

FIGS. 1B, 7A 7B, 8B, and 9 show an uninterrupted endless seal 12 that completely surrounds the nostrils and mouth. FIGS. 5A and 5B show the neutralizing agent 66 extending from a top side to a bottom side of the covering 16 and from a right side to a left side of the covering 16 such that any air passing through the covering 16 confronts the neutralizing agent 66.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A sealed face mask, comprising:

a) a covering for the nostrils and mouth;

b) wherein the covering includes a periphery completely surrounding the nostrils and mouth, wherein the periphery is structured to extend from a first position on the bridge of the nose above the nostrils to the right side of the nose, from said right side of the nose to a position on the front of the face beyond the right side of the mouth, from said position beyond the right side of the mouth to a position on the front of the face below the lower lip and on the front of the chin, from said position below the lower lip to a position on the front of the face beyond the left side of the mouth, from said position beyond the left side of the mouth to the left side of the nose, from said left side of the nose back to said first position on the bridge of the nose such that the nostrils and mouth are completely surrounded;

c) wherein the covering comprises a portion projecting beyond the mouth, with the portion projecting beyond the mouth being within the periphery and being convex relative to an exterior of the portion;

d) wherein the covering is structured to permit air into and out of the covering;

e) wherein the covering is structured to minimize a flow of substances into and out of the covering;

f) a neutralizing agent engaged to the covering where the covering is structured to permit air into the covering to maximize the chances that substances passing through the covering are rendered less harmful by the neutralizing agent, with the neutralizing agent extending from a top side to a bottom side of the covering and from a right side to a left side of said covering such that any air passing through said covering confronts the neutralizing agent;

g) wherein the neutralizing agent comprises activated charcoal;

h) a seal on an entirety of the periphery, with the seal being an uninterrupted endless seal adapted to completely surround the nostrils and mouth, wherein the seal includes an adhesive that sticks to skin to minimize an amount of substances that access the nostrils and mouth via a route between the periphery and the face and to maximize the amount of substances that are trapped by the covering, wherein the adhesive extends entirely about the periphery; and i) wherein the adhesive comprises a styrene-olefin-styrene block copolymer.

2. A sealed face mask, comprising:

a) a covering for the nostrils and mouth;

b) wherein the covering includes a periphery completely surrounding the nostrils and mouth, wherein the periphery is structured to extend from a first position on the bridge of the nose above the nostrils to the right side of the nose, from said right side of the nose to a position on the front of the face beyond the right side of the mouth, from said position beyond the right side of the mouth to a position on the front of the face below the lower lip and on the front of the chin, from said position below the lower lip to a position on the front of the face beyond the left side of the mouth, from said position beyond the left side of the mouth to the left side of the nose, from said left side of the nose back to said first position on the bridge of the nose such that the nostrils and mouth are completely surrounded;

c) wherein the covering comprises a portion projecting beyond the mouth, with the portion projecting beyond the mouth being within the periphery and being convex relative to an exterior of the portion;

d) wherein the covering is structured to permit air into and out of the covering;

e) wherein the covering is structured to minimize a flow of substances into and out of the covering;

f) a seal on an entirety of the periphery, with the seal being an uninterrupted endless seal adapted to completely surround the nostrils and mouth, wherein the seal includes an adhesive that sticks to skin to minimize an amount of substances that access the nostrils and mouth via a route between the periphery and the face and to maximize the amount of substances that are trapped by the covering, wherein the adhesive extends entirely about the periphery; and g) wherein the adhesive comprises a styrene-olefin-styrene block copolymer.

* * * * *